US007144269B2

(12) United States Patent
Libby et al.

(10) Patent No.: US 7,144,269 B2
(45) Date of Patent: Dec. 5, 2006

(54) HINGED ELECTRICAL CONNECTOR FOR INSULATED CABLE

(75) Inventors: Robert A. Libby, Williamsport, PA (US); Devin B. Decker, Spring Mills, PA (US)

(73) Assignee: Aslan Industries Corporation

( * ) Notice: Subject to any disclaimer, the term of this patent is extended or adjusted under 35 U.S.C. 154(b) by 582 days.

(21) Appl. No.: 10/669,497

(22) Filed: Sep. 23, 2003

(65) Prior Publication Data

US 2005/0064759 A1 Mar. 24, 2005

(51) Int. Cl.
*H01R 4/24* (2006.01)

(52) U.S. Cl. ..... 439/409

(58) Field of Classification Search ..... 439/409, 439/410, 412, 426, 432, 391
See application file for complete search history.

(56) References Cited

U.S. PATENT DOCUMENTS

| | | | | |
|---|---|---|---|---|
| 2,717,365 | A | 9/1955 | Greenbaum | |
| 3,641,472 | A | 2/1972 | Phillips, Jr. | |
| 3,716,651 | A | 2/1973 | Werner | |
| 3,828,113 | A | 8/1974 | Bourne | |
| 4,165,443 | A | 8/1979 | Figart et al. | |
| 4,268,109 | A | 5/1981 | Hardesty | |
| 4,336,418 | A | 6/1982 | Hoag | |
| 4,341,430 | A * | 7/1982 | Crawford | 439/409 |
| 4,402,564 | A | 9/1983 | Frantz | |
| 4,485,282 | A | 11/1984 | Lee | |
| 4,634,212 | A | 1/1987 | Boundy et al. | |
| 4,842,551 | A | 6/1989 | Heimann | |
| 4,918,258 | A | 4/1990 | Ayer | |
| 4,924,032 | A | 5/1990 | Akins | |
| 4,958,048 | A | 9/1990 | Bell | |
| 5,015,203 | A | 5/1991 | Furrow | |
| 5,064,385 | A | 11/1991 | Harlow, Jr. | |
| 5,178,555 | A | 1/1993 | Kilpatrick et al. | |
| 5,334,044 | A | 8/1994 | Falossi et al. | |
| 5,435,747 | A * | 7/1995 | Franckx et al. | 439/409 |
| 5,785,548 | A * | 7/1998 | Capper et al. | 439/409 |
| 5,785,551 | A | 7/1998 | Libby | |
| 5,961,341 | A * | 10/1999 | Knowles et al. | 439/403 |
| 5,975,938 | A | 11/1999 | Libby | |
| 6,074,238 | A * | 6/2000 | DeRoss et al. | 439/409 |
| 6,152,760 | A * | 11/2000 | Reeser | 439/409 |
| 6,406,324 | B1 * | 6/2002 | Duesterhoeft et al. | 439/409 |

* cited by examiner

*Primary Examiner*—Tulsidas C. Patel
*Assistant Examiner*—Harashad C Patel
(74) *Attorney, Agent, or Firm*—Thomas R. Shaffer

(57) ABSTRACT

An electrical connector provides an electrical connection to an unstripped end of an insulated electrical cable of the type having an outer sheath within which an insulated hot wire, an insulated neutral wire, and a ground wire are enclosed. The connector has a body formed of an electrically insulating material and a cavity in a first body end sized to receive an unstripped end of the cable. A lid is pivotally connected to the body which is adapted to rotate around an axis of rotation between and open position and a closed position. A hot blade conductor, a neutral blade conductor, and at least one ground blade conductor are positioned in the lid. The blade conductors each have at least one downwardly depending blade and an outlet portion. The blades conductors are spaced apart. When the lid is in open position, the blades do not extend within said cavity. When the lid in a closed, the blades do extend within the cavity and make an electrical connection with the hot, neutral and ground wires of the cable.

62 Claims, 10 Drawing Sheets

HINGED ELECTRICAL CONNECTOR FOR INSULATED CABLE

BACKGROUND OF THE INVENTION

1. Field of the Invention

The present invention relates to an electrical connector for insulated cable. More particularly, it relates to a connector which can be utilized without tools to quickly and effectively make an electrical connection to a hot conductor wire, a neutral conductor wire and a ground wire which are encased in an outer sheath of a transversely cut unstripped end of insulated electrical cable.

2. Prior Art

It has long been known to provide a body member having a pivotally mounted lid having blade members therein to make an electrical connection to an electrical cord by piercing the insulation with the blade members. An example of such a device is shown and described in Greenbaum, U.S. Pat. No. 2,717,365. The Greenbaum device is effective for quickly attaching an outlet receptacle and a product manufactured in accordance with the teachings of such patent is still being sold as catalog number BP2603B and part number 2603H of Eagle Electric Mfg. Co., Inc. While useful for a limited purpose, such device has severe limitations. First, it is designed solely for use on an electric cord having two insulated wires (in the form of a standard lamp cord). Even within such limited range of use, with such cords may not be utilized on very small width cords such as type "TPT" (used on electric shavers) or type "XT" (used on tiny Christmas lights). Further, such device is not designed for use and may overheat if used in connection with broilers, toasters, irons or other devices rated over 1250 watts (10 amps and 125 volts).

The present invention on the other hand does not relate to a connector for lamp cord but rather relates to an improved device for making an electrical connection to an unstripped end of an insulated electrical cable of the Romex type which has an outer sheath within which an insulated hot wire, an insulated neutral wire, and a ground wire are enclosed. Providing a reliable connector which, with separate blade members, pierces through both the outer sheath and the separate layer of insulation on the hot and neutral wires and makes a connection with such wires, and which also cuts through and makes a reliable connection with a separate ground wire contained in the cable is a far more difficult task.

Additional background of the present invention and prior art applicable to the present invention is discussed in detail in Libby, U.S. Pat. No. 5,785,551 and Libby, U.S. Pat. No. 5,975,938. The complete specification of each of these patents is hereby incorporated herein by reference thereto.

Libby, U.S. Pat. No. 5,785,551 teaches that it is desirable to reduce and simplify the number of steps required in wiring an electrical power distribution system and to make electrical connections without the need to strip the ends of the individual conductors in an electrical cable. FIGS. 13*a* through 13*d* show and describe a device used to make an electrical connection to a transversely cut unstripped end of insulated electrical cable having at least two individually insulated conductors which are encased in an outer sheath. With that system, a special pair of pliers is utilized to drive generally parallel spaced apart individual blade members downwardly through the outer sleeve of the cable, through the conductor insulation and into an electrical connection, respectively, with each of the wire conductors.

Libby, U.S. Pat. No. 5,975,938 teaches the provision of an electrical connector for insulated cable including a body, a pair of arm members, a pair of electrically conducting blade members, an electrical output means and an electrical pathway between the blades and the output means. When the arm members are moved from an open position to a closed position with an unstripped end of insulated electrical cable present in the cavity, the blade members cut through the outer sheath of the cable and also cut through the insulation of the individually insulated conductors and the blades move to a location where said blade members are in electrically contact with said conductors. While generally effective, the provision of separate arm members adds unnecessary complexity to the connector and the design shown may not always make a reliable connection to an unstripped ground wire in the cable.

Thus, while these systems are functional and each constitutes an improvement over the prior art, there remains a need for a more effective, more expedient and less expensive connector which can make a reliable connection to an insulated hot wire, an insulated neutral wire and to a ground wire present within an outer sheath of an unstripped electrical cable.

SUMMARY OF THE INVENTION

It is an object of the present invention to provide a connector with a cavity sized to receive an unstripped end of an electrical cable and which efficiently makes an electrical connection between a hot, neutral and ground wire of the cable and an output of the connector which can be adapted for compatible connection with a variety of existing prewired junction boxes, coupling devices, plug receptacles, fixtures, switches and the like.

The present invention provides an electrical connector for providing an electrical connection to an unstripped end of an insulated electrical cable having an outer sheath within which an insulated hot wire, an insulated neutral wire, and a ground wire are enclosed. In its simplest form, the present invention includes a body formed of an electrically insulating material, said body having a first body end and a second body end, said body having a cavity in said first body end sized to receive said unstripped end of insulated electrical cable; a lid having a first lid end and a second lid end, said second lid end pivotally connected to said second body end, said lid adapted to rotate around an axis of rotation between and open position and a closed position; and plural blade conductors attached to said lid comprising a hot blade conductor, a neutral blade conductor, and at least one ground blade conductor, said blade conductors each having blade end comprising at least one downwardly depending blade and an outlet portion, said blades conductors being spaced apart and attached to the lid whereby when said lid is in open position said blades do not extend within said cavity and when said lid in a closed position said blades do extend within said cavity.

The body of the present invention, unless otherwise stated below, preferably has the following features though such features are not required.

The cavity in said body may have a generally oval cross sectional configuration and may have a central ridge a bottom portion of said cavity. Alternatively, the cavity in said body may a generally rectangular cross sectional configuration with rounded corners and may have a central ridge a bottom portion of said cavity. Alternatively, the cavity in said body may have a generally figure "8" shaped cross sectional configuration with a central ridge provided on a bottom portion of said cavity and a second central ridge on a top portion of said cavity. Preferably, however, said cavity in said body has a generally "B" shaped cross sectional configuration with rounded corners with a central ridge provided on a bottom portion of said cavity and a generally flat surface on a top portion of said cavity.

The cavity is adapted to receive an insulated electrical cable from one of a finite set of insulated electrical cable manufactures which each produce cables of differing widths wherein the width of said cavity is equal to the width of the most narrow cable manufactured by said finite set of manufacturers whereby sides of the cavity provide at least some frictional resistance such that the cable fits snugly within said cavity. The cavity is adapted to receive an insulated electrical cable from one of a finite set of insulated electrical cable manufactures which each produce cables having a different volume of paper insulation whereby rounded portions of the cavity located on opposite side of said central ridge provide a sufficient volume of space to allow said unstripped end of insulated electrical cable from the manufacturer with the greatest volume of paper insulation to deform such that the cable fits snugly within said cavity.

The body has a top body surface, said top body surface having a hot blade opening, a neutral blade and at least one ground blade opening therein. The hot blade opening, neutral blade opening and at least one ground blade opening each extend from said top body surface into said cavity. The hot blade opening, neutral blade opening and at least one ground blade opening are positioned to receive, respectively, the blade ends of said hot blade conductor, said neutral blade conductor and said at least one ground blade conductor.

The body has opposite surfaces, said opposite side surfaces each having a textured gripping surface. The textured gripping surfaces aid the use in gripping the connector during an insertion of an insulated electrical cable into the connector. The textured gripping surfaces also aid the user in gripping the connector while moving the lid from said open to said closed position.

The second body end has a central recess and a pair of ears on opposite sides of said central recess. Each of said ears has a hinge opening along said an axis of rotation.

The body has at least one primary latch opening. The body also has at least one secondary latch opening. The body also has a pair of lock release tabs on opposite sides of said body to allow the electrical connector to be removably secured to compatible electrical devices. The body is fabricated from a lower body portion and an upper body portion which are permanently affixed together to form said body.

The lid of the present invention, unless otherwise stated below, preferably has the following features though such features are not required.

The lid is asymmetrical in cross sectional configuration. The lid has a least one opposite side wall surface portion which is formed at an angle not equal to 90 degrees relative to a top surface of said lid.

The lid includes at least one primary latch finger which is adapted to be received by at least one primary latch opening in said body when said lid is moved from an open to a closed position. The at least one primary latch finger secures said lid in closed position. The at least one primary latch finger is adapted to enter but not exit said at least one primary latch opening whereby once said lid is closed it is permanently secured in a closed position and can not be reopened. The at least one primary latch finger has a lower inclined surface thereon which, as the lid is moved from an open to a closed position, urges said at least one primary latch finger inwardly toward a centerline of said at least one primary latch opening until said lower inclined surface reaches a primary recess in said at least one primary latch opening and wherein said at least one primary latch finger has a latching ledge surface thereon, said latching ledge surface adapted to engage a locking surface within said at least one primary latch opening once said lower inclined surface reaches said primary recess. The lower inclined surface and said latching ledge surface are in the form of a generally triangular tooth portion on a lower end of said at least one primary latch finger.

The lid includes at least one secondary latch finger. The at least one secondary latch finger is adapted to be received by at least one secondary latch opening in said body when said lid is moved from an open to a partially closed position. The at least one secondary latch finger secures said lid in a partially closed position. The at least one secondary latch finger is adapted to enter but and exit said at least one secondary latch opening whereby once said lid is partially closed it is held in such partially closed position by friction but can be reopened to an open position by applying sufficient upward force to said lid. The at least one secondary latch finger has a lower inclined surface thereon which, as the lid is moved from an open to a partially closed position, urges said at least one secondary latch finger inwardly toward a centerline of said at least one secondary latch opening until said lower inclined surface reaches a secondary recess in said at least one secondary latch opening and wherein said at least one secondary latch finger also has an upper inclined surface thereon which, as the lid is moved from an partially closed to an open position, urges said at least one secondary latch finger inwardly toward a centerline of said at least one secondary latch opening allowing the lid to be moved to an open position. The lower inclined surface and said upper inclined surface are in the form of a generally semi-circular protrusion on a lower end of said at least one secondary latch finger.

The lid further comprises a pair of spaced apart insulating plates which are positioned on opposite sides of an end of said ground conductor when said lid is in a closed position whereby the possibility of arcing of electrical current between an end of said ground conductor and an end of one of said insulated hot wire and said insulated neutral wire is reduced by said insulating plates.

The second lid end is provided with at least three outlet openings to provide access from outside of said connector to said hot blade conductor, said neutral blade conductor, and said at least one ground blade conductor.

The lid has a hot blade conductor channel, a neutral blade conductor channel, and said at least one ground blade conductor channel on an inner surface thereof adapted to receive and position, respectively, hot blade conductor, said neutral blade conductor, and said at least one ground blade conductor. The first end of said lid has downwardly extending grip strain relief member adapted to grip against and securely hold said insulated electrical cable within said electrical connector when said lid is moved to a closed position.

The lid has a generally planar configuration on said first end and has a generally cylindrical lid portion provided on said second end, said cylindrical lid portion adapted to be attached for pivotal movement within a central recess in said body portion between a pair of ears provided on opposite sides of said central recess on said body. The lid is formed from an upper lid member and a lower lid member between which said plural blade conductors are positioned and attached.

The blade conductors of the present invention, unless otherwise stated below, preferably has the following features though such features are not required.

The blade portions of said hot blade conductor, said neutral blade conductor, and said at least one ground blade conductor make electrical contact, respectively, with a hot conductor wire, a neutral conductor wire, and a ground conductor wire when said lid is moved from an open to a closed position with an unstripped end of an insulated electrical cable present in said cavity.

The at least one ground blade conductor includes a pair of spaced apart blade members wherein in a closed position a ground blade member is in electrical contact on opposite sides of a single ground conductor wire. The pair of said ground blade members aid in securing and holding said ground conductor wire in a desired position within the electrical connector when said lid is in a closed position. The pair of ground blade members are spaced apart a distance no greater than the diameter of said ground conductor wire. The pair of ground blade members are spaced apart a distance slightly less than the diameter of said conductors and wherein said spaced apart blades exert inward force on opposite sides of said conductors.

When said lid is moved from an open position to a closed position, with an unstripped end of insulated electrical cable present in the cavity, said ground blade members slice through the outer sheath of and move to a location where said ground blade members are in electrically contact with ground conductor wire. When said lid is moved from an open position to a closed position, with an unstripped end of insulated electrical cable present in the cavity, said blade portions of said hot blade conductor and said neutral blade conductor, respectively, puncture through said outer sheath and puncture through the insulation of said hot conductor wire and said neutral conductor wire. The hot wire conductor blade makes electrical contact with said hot conductor wire on a side of said hot wire most distant from said ground wire and said neutral wire conductor blade makes electrical contact with said neutral conductor wire on a side of said neutral wire most distant from said ground wire.

The at least one ground wire conductor blade is generally "L" shaped. The at least one ground wire conductor blade is provided along a front edge and along a bottom edge of a generally rectangular insulating plate member. The at least one ground wire conductor blade has a bottom edge blade portion. The bottom edge blade portion slices the outer sheathing as the lid is moved from an open position to a closed position when an insulated cable is present in the cavity.

The at least one ground wire conductor blade has a front edge blade portion. The front edge blade portion has a central blade segment, said central blade segment deformed inwardly with respect to said front edge blade portion, said central blade segment has a leading edge, whereby when the lid is moved from an open position to a closed position with an insulated cable present in the cavity, said leading edge of said central blade segment cuts into a side portion of the ground conductor wire. The central blade segment is deformed inwardly with respect to said front edge blade portion at an angle of approximately 17 degrees.

The hot blade conductor and said a neutral blade conductor have blades have a forward edge which is curved along arc having a radius point located at an axis of rotation of said lid. The hot blade conductor and said a neutral blade conductor have blades having a sharp point on a lowermost end thereof.

Each outlet portion of said conductor blade members is preferably in the form of either a male plug member or a female receptacle member, but is preferably a female receptacle.

DETAILED DESCRIPTION OF THE PREFERRED EMBODIMENTS

Referring to the figures, an electrical connector 30 is shown for providing an electrical connection to an unstripped end 12 of an electrical cable 10 which has an outer sheath 14, an insulated hot wire H, an insulted neutral wire N and an insulated ground wire G.

Figure 5:
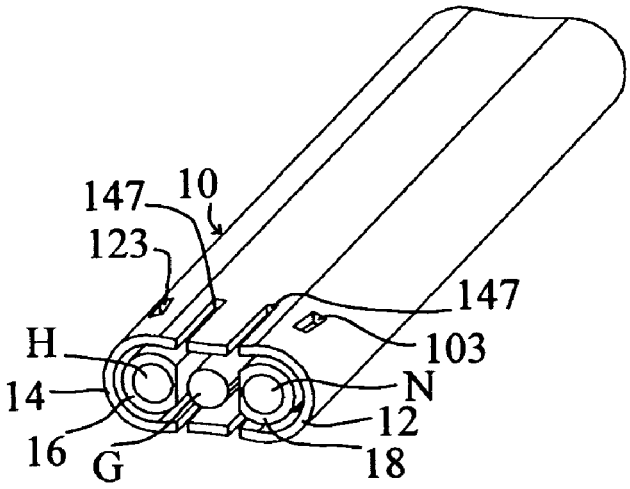
FIG. 5 is an isometric view showing an insulated electrical cable.
Figure 6:
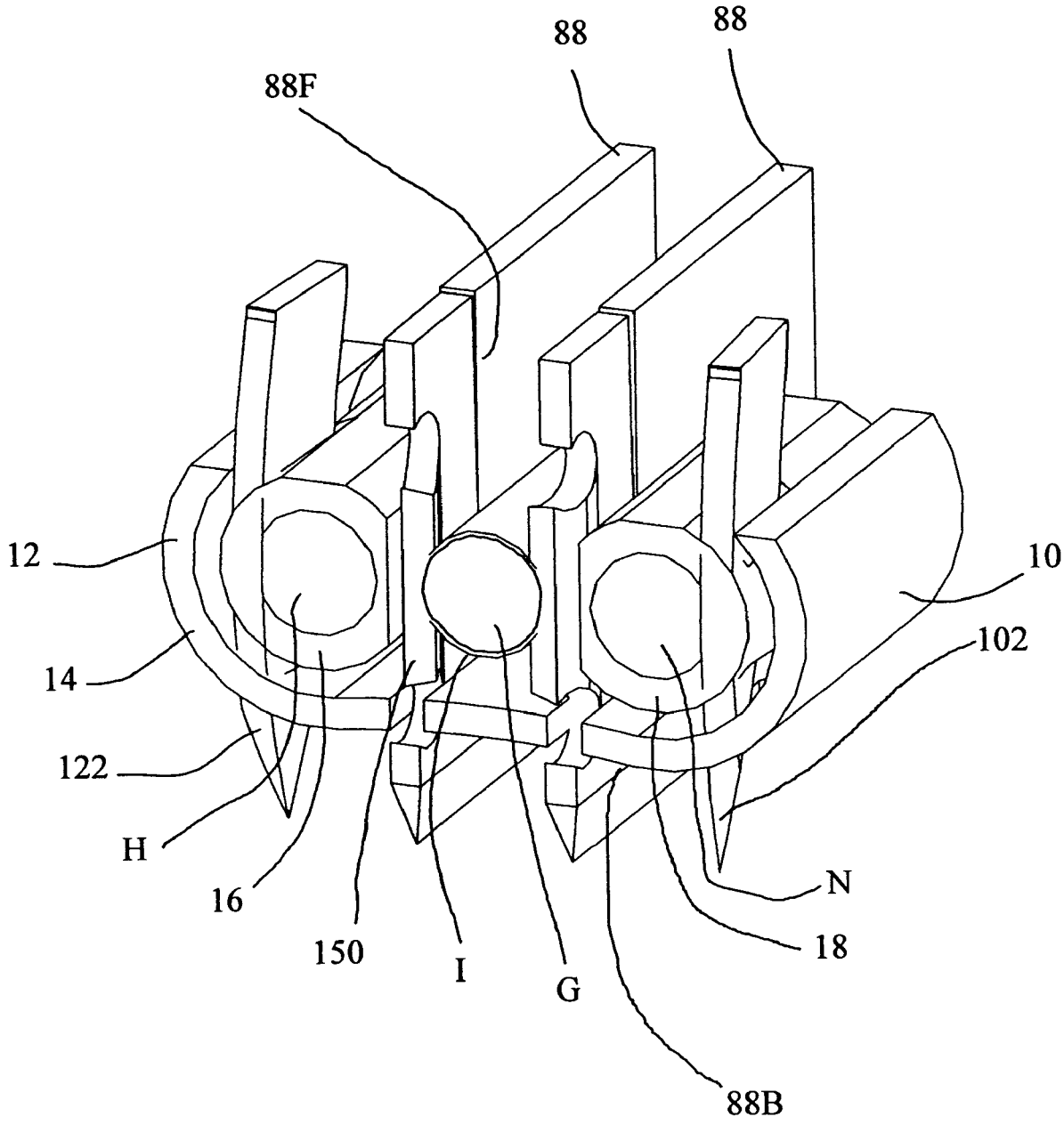
FIG. 6 is an isometric view of an insulated electrical cable having blade members of the present invention making an electrical connection.

As best shown in FIGS. 5 and 6, the hot wire H has insulation 16 therearound, neutral wire N has insulation 18 therearound and ground wire G has a paper insulation I therearound. All of these wires are encased in an outer sheath 14 as shown.

A body 40 is provided from an electrically insulating material. The body 40 has a first end 42 and a second end 44. The body 40 has a cavity 50 in the first body end 42 sized to receive an unstripped end 12 of said insulated electrical cable 10.

Figure 1:
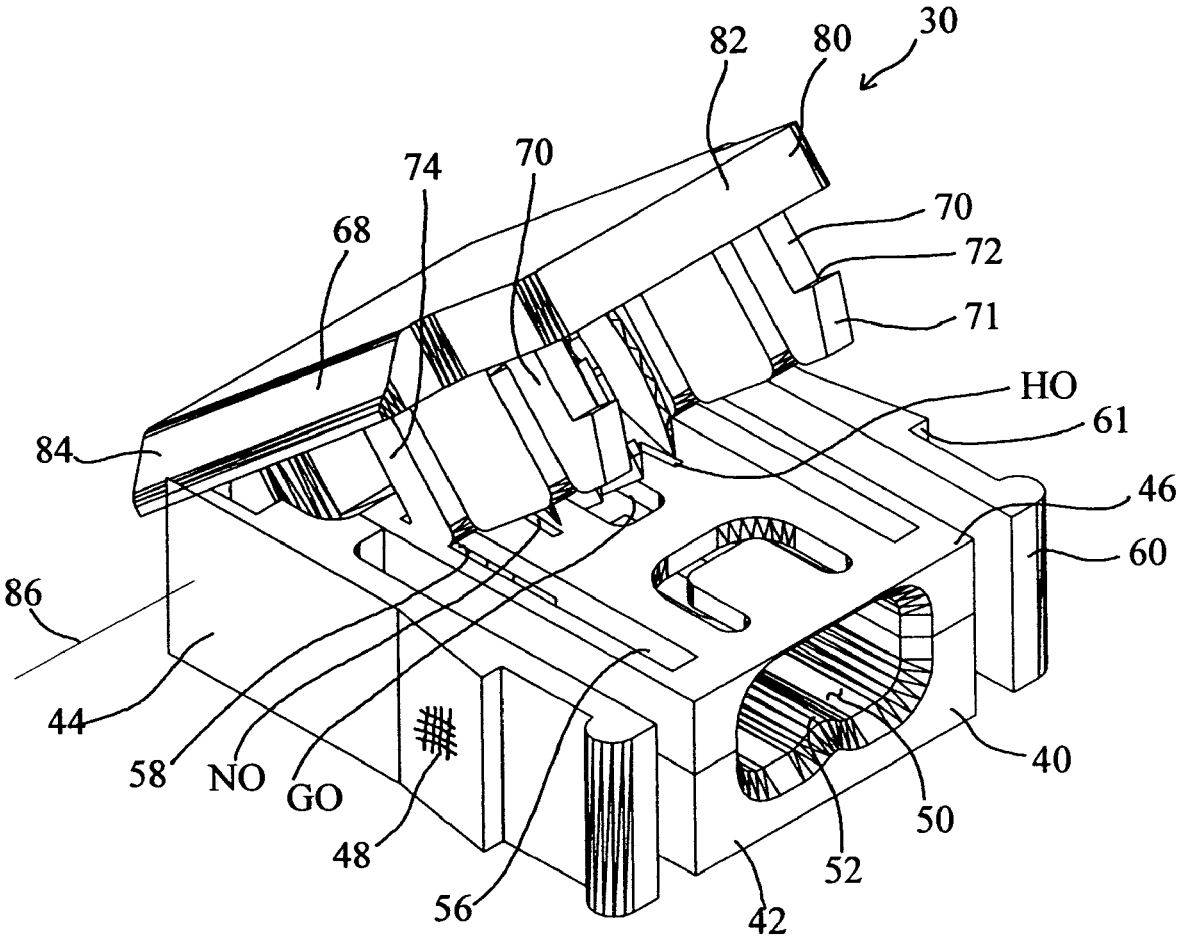
FIG. 1 is an isometric view of the electrical connector of the present invention.
Figure 2:
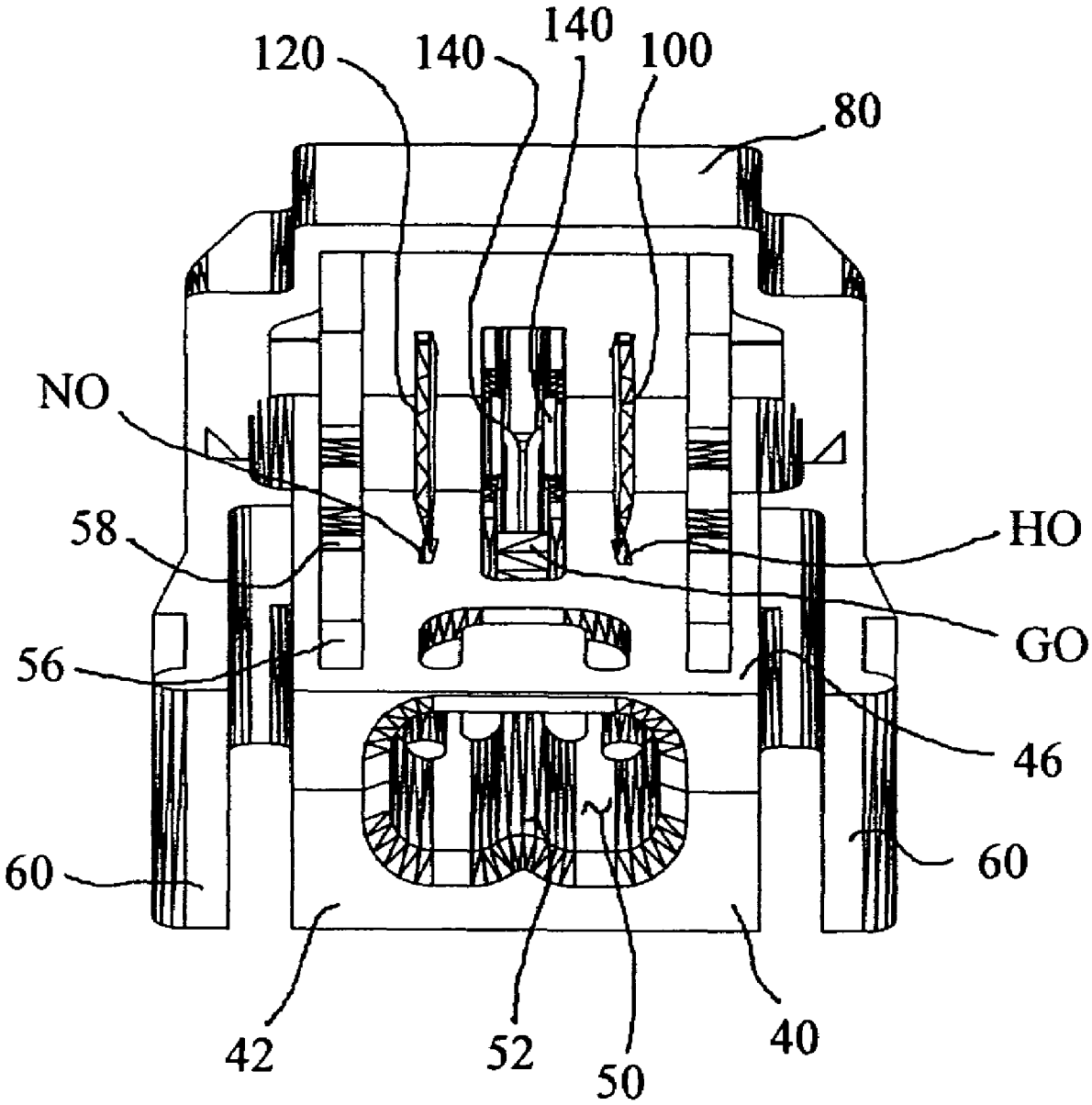
FIG. 2 is a perspective view from the front showing the electrical connector of the present invention with the lid in an open position.
Figure 3:
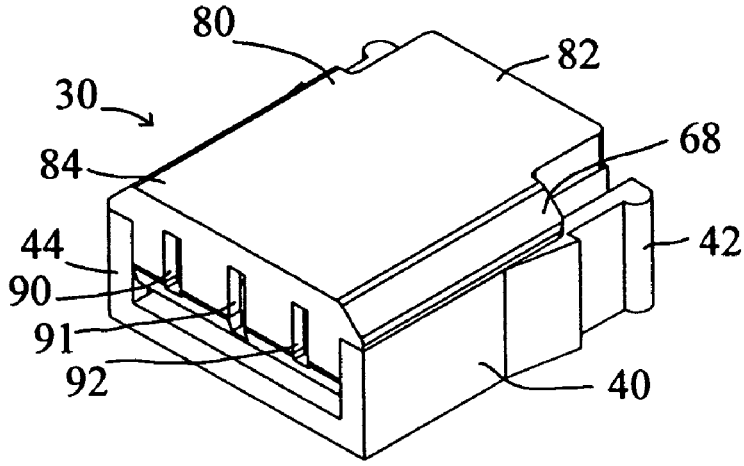
FIG. 3 is an isometric view showing the second end of the electrical connector of the present invention.
Figure 4:
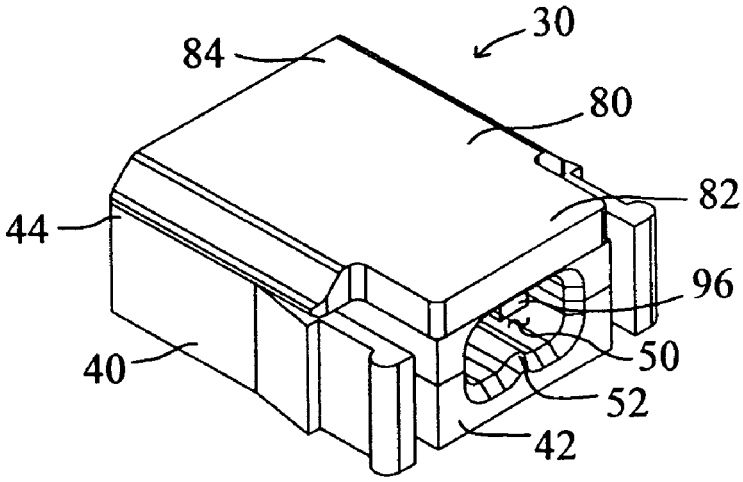
FIG. 4 is an isometric view showing the first end of the electrical connector of the present invention.

The present invention also includes a lid 80 having a first lid end 82 and a second lid end 84. The second lid end 84 is pivotally connected to the second body end 44 and the lid 80 is adapted to rotate about an axis of rotation 86 between an open position as shown in FIGS. 1 and 2 and a closed position as shown in FIGS. 3 and 4.

Figure 21:
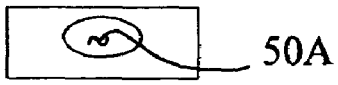
FIG. 21 is a front elevational view of an electrical connector having an oval shaped cavity.

Plural blade conductors are attached to the lid 80 and include a hot blade conductor 100, a neutral blade conductor 120 and at least one ground blade conductor 140. The blade conductors have a blade end 102, 122 and 142 comprising at least one downwardly depending blade 104, 124, 144 and an outlet portion 106, 126, 146. The blades 100, 120 and 140 are spaced apart and attached to the lid whereby when the lid 80 is in an open position, the blades do not extend within the cavity 50 and when the lid is in a closed position, the blades do extend within the cavity 50. Referring to FIG. 21, the cavity is shown having an oval cross-sectional configuration.

Figure 22:
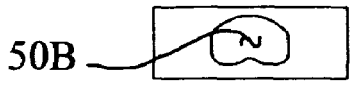
FIG. 22 is a front elevational view of an electrical connector having an oval shaped cavity with a central ridge in a bottom portion thereof.

Referring to FIG. 22, a cavity 50B is shown having an oval cross-sectional configuration with a central ridge in a bottom portion of the cavity.

Figure 23:
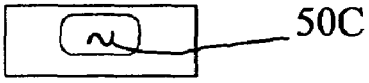
FIG. 23 is a front elevational view of an electrical connector having a rectangular shaped cavity.

Referring to FIG. 23, a cavity 50C is shown to be generally rectangular and cross-sectional configuration with rounded corners.

Figure 24:
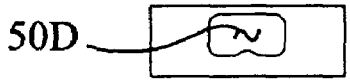
FIG. 24 is a front elevational view of an electrical connector having a rectangular shaped cavity with rounded corners and a central ridge in a bottom portion thereof.

FIG. 24 shows a cavity 50D which is generally rectangular with rounded corners but with a central ridge on a bottom portion of the cavity.

Figure 8:
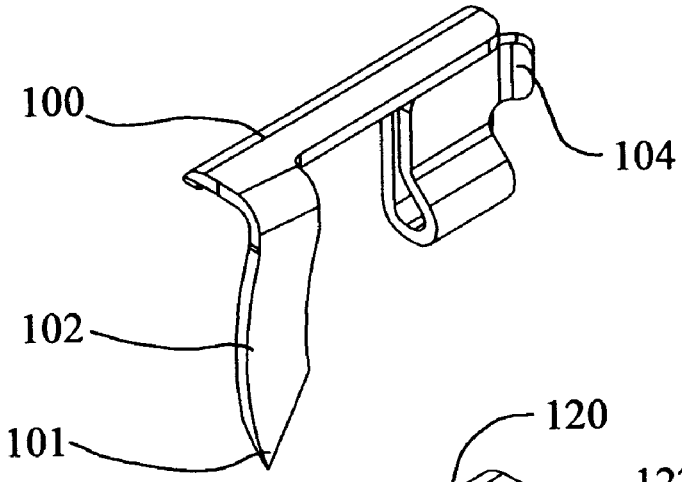
FIG. 8 is an isometric view of the neutral blade conductor of the present invention.
Figure 9:
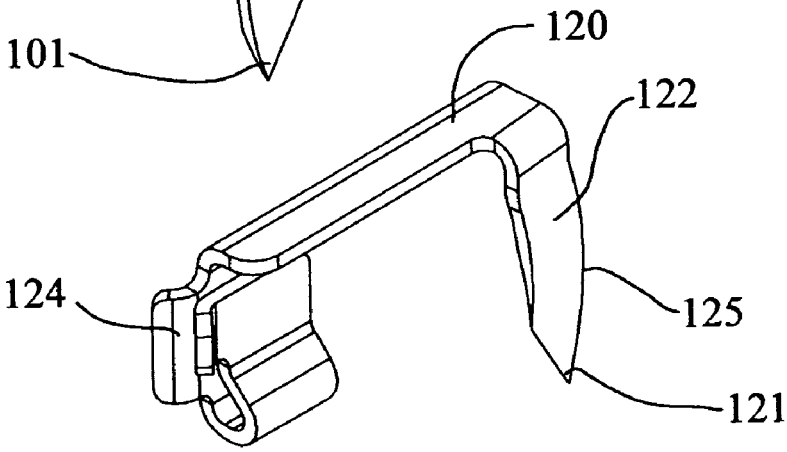
FIG. 9 is an isometric view of the hot blade conductor of the present invention.
Figure 10:
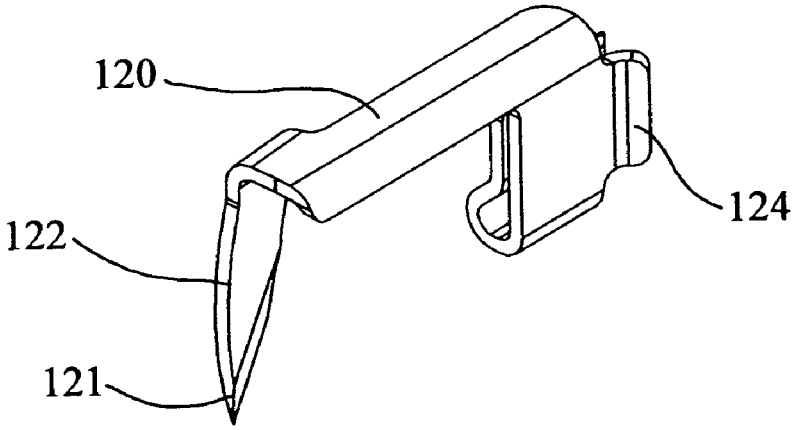
FIG. 10 is an isometric view of the hot blade connector of the present invention.
Figure 11:
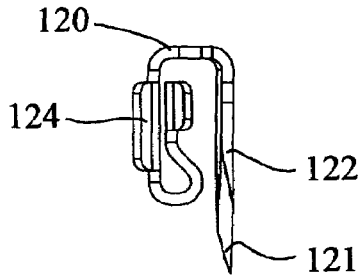
FIG. 11 is a rear view of the hot blade connector of the present invention.
Figure 12:
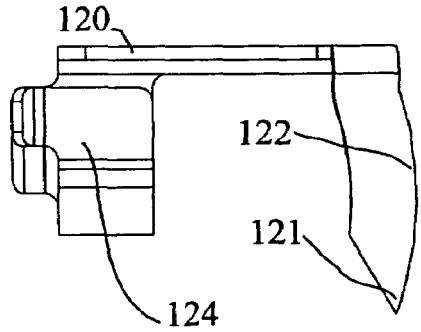
FIG. 12 is a side elevational view of the hot blade conductor of the present invention.
Figure 25:
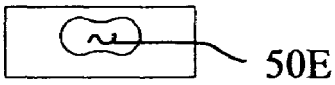
FIG. 25 is a front elevational view of an electrical connector having a generally figure "8" shaped cavity.

FIG. 25 shows a cavity having a cross-sectional configuration as shown at 50E which is generally FIG. 8 shaped with a first central ridge provided on a bottom portion of the cavity in a second central ridge on a top portion of the cavity. As can be seen, the opening shown in FIGS. 22 and 24 are generally "B" shaped in cross-sectional configuration.

After extensive testing, applicant's have discovered that the cross-sectional configuration of the cavity may be critical in providing an electrical connection which is reliable even when used with electrical cables from different manufacturers which have slightly different cross-sectional configurations or volumes of paper insulation "I" included in the cable 10. Thus, applicants presently prefer to utilize a cavity having a cross-sectional configuration as shown in FIG. 24.

The body 40 of the electrical connector of the present invention has a top surface 46. Said top body surface 46 has a hot blade opening HO therein, a neutral blade opening NO therein and at least one ground blade opening GO therein. As is shown, when the lid 80 is moved from an opened to a closed position, the blade members 102, 122 and 142, respectively pass through the openings HO, NO and GO.

Although not required, opposite side surfaces of the body 40 may have a textured gripping surface 48 provided thereon. Such gripping surfaces aid in the use of gripping the connector during the insertion of an insulated electrical cable into the connector.

The body 40 also has a central recess 49 therein and a pair of ears 52 on opposite sides of the central recess 49.

Figure 19:
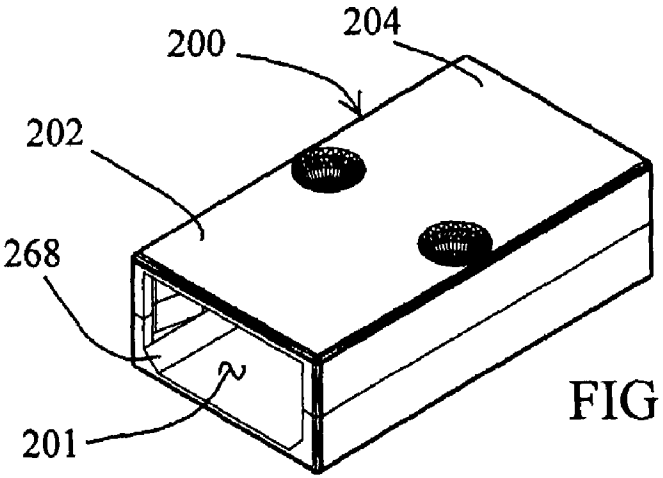
FIG. 19 is an isometric view of the coupling device of the present invention.
Figure 20:
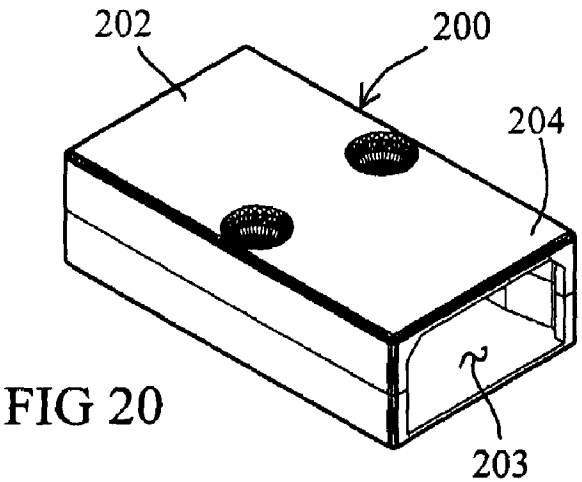
FIG. 20 is an exploded view of the coupling device of the present invention.
Figure 18:
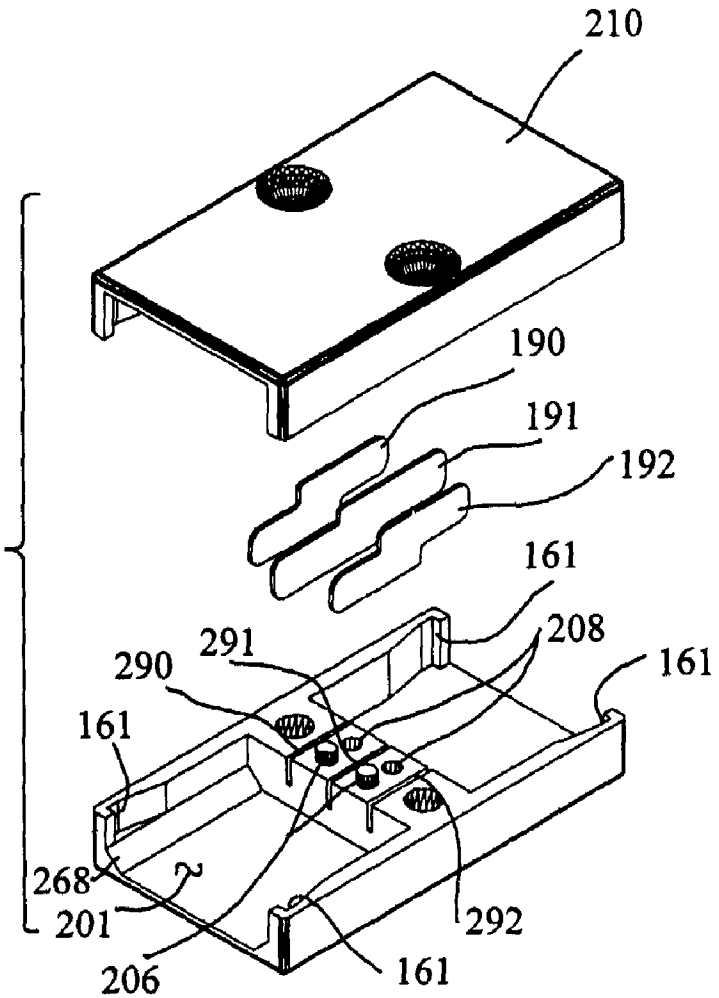
FIG. 18 is an isometric view of the coupling device of the present invention.

Each of the ears 52 has a hinge opening 54 therein along said axis of rotation 86. Preferably, the body 40 has at least one primary latch opening 56 and at least one secondary latch opening 58. The body 40 also has a pair of lock release tabs 60 on opposite sides of the body to allow the electrical connector 30 to be removably secured to compatible electrical devices. For example, an electrical coupler is shown in FIGS. 18, 19 and 20. As best shown in FIG. 18, electrical coupler is formed of two identical members 210. The coupler has an opening 201 provided at a first end 202 and a second opening 203 provided a second end 204. Three electrically conducting blade members 190, 191 and 192 are secured respectively in slots 290, 291 and 292. The two identical components 210 are secured together by posts 206 which enter into corresponding holes 208. Once assembled, it will be obvious that the release tabs 60 of the electrical connector of the present invention are adapted to be received and lock into recesses 161 on the coupling device 200. A similar connection is made to other types of compatible electrical devices such as prewired junction boxes, switches, plug receptacles and other fixtures of the type generally used in building construction.

It can be seen that at least one opposite side wall surface portion 68 of the body is formed at an angle not equal to 90 degrees. This angled surface 68 is adapted to be received by the corresponding angled portion of a compatible electrical device such as surface 268 of the coupling device 200 as shown in FIGS. 18, 19 and 20. This prevents the possibility of connecting a hot wire H to a neutral wire N.

A primary latch finger 70 is provided to permanently secure the lid 80 in a closed position once it is fully closed into the body 40. It can be seen that primary latch finger 70 includes a lower inclined surface 71 and has a latching ledge 72 thereon. The inclined surface forms a generally formed triangular tooth portion 71 on the lower end of the primary latch finger. Once this latch finger is fully inserted into the primary latch openings 56 of the body, the ledge 72 prevents the lid 80 from being thereafter opened.

Because the blade members are sharp and delicate, it is preferable that they be protected during shipping and handling to prevent damage to the blade members themselves and also to prevent injury to users of the electrical connector. Accordingly, the present invention also preferably includes a secondary latch finger 74 which has a lower inclined surface 75 thereon which as the lid is moved from an opened to a partially closed position, urges the secondary latch finger 74 toward a centerline of the secondary latch opening until the lower inclined surface 75 reaches a secondary recess. An upper inclined surface 76 is also provided on the secondary latch finger 74 to allow the lid to again be opened even after the secondary latch is engaged in the recess in the body. As can be seen, the upper and lower inclined surfaces 75 and 76 form a generally semi-circular protrusion on the lower end of the secondary latch finger. As the lid is moved from an opened to a partially closed position, this lower end portion enters secondary latch opening 58 and releasably secures the lid in a partially closed position.

Another feature of the present invention which makes it particularly useful is that a pair of spaced apart insulating plates 88 are provided on opposite sides on an end of the ground conductor when the lid is in a closed position. The insulating plates, as shown in FIG. 6, are provided along an end of the ground wire G and prevent arching from the ground wire G to either the hot or neutral wires.

The second lid end is preferably provided with three outlet openings 90, 91 and 92 to provide access from the outside of the connector to said hot blade conductor, said at least one ground blade conductor and said neutral blade conductor.

As shown in FIG. 4, the present invention may provide a downwardly extending grip strain relief member 96 adapted to grip against and securely hold the insulated electrical cable 10 within the electrical conductor 30 when the lid 80 is moved to a closed position.

The lid 80 preferably has a generally planer configuration on a first end 81 thereof and has a generally cylindrical lid portion provided on a second end 83 thereof. The cylindrical lid portion 83 is provided between the pair of spaced apart ears 52 provided on opposite sides of the central recess 49 on the body portion 40.

Figure 7:
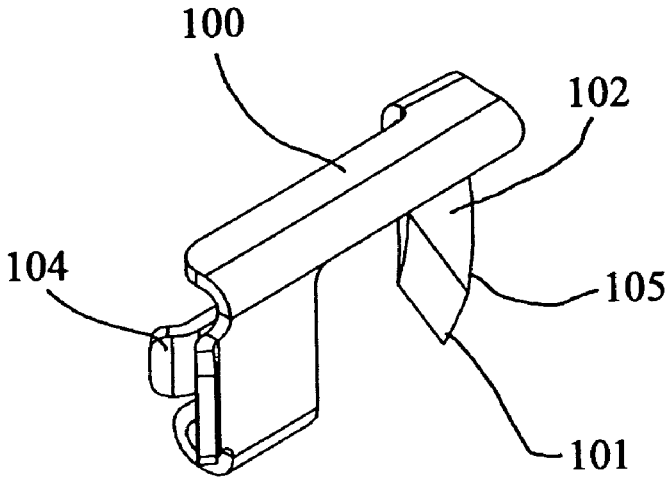
FIG. 7 is an isometric view of the neutral blade conductor of the present invention.
Figure 14:
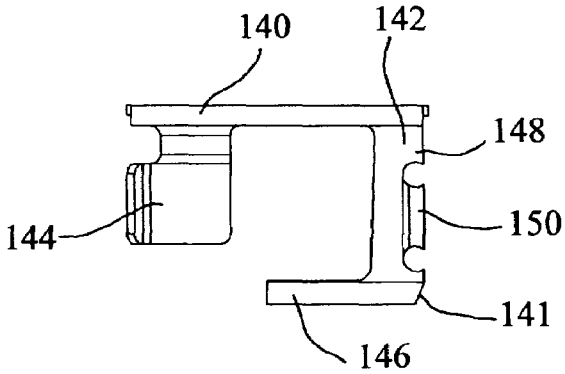
FIG. 14 is a side elevational view of the ground blade conductor of the present invention.
Figure 15:
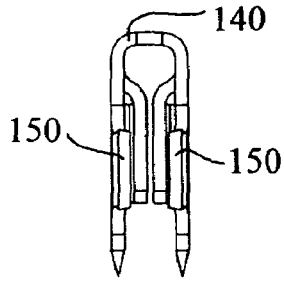
FIG. 15 is an end view of the ground blade conductor of the present invention.
Figure 13:
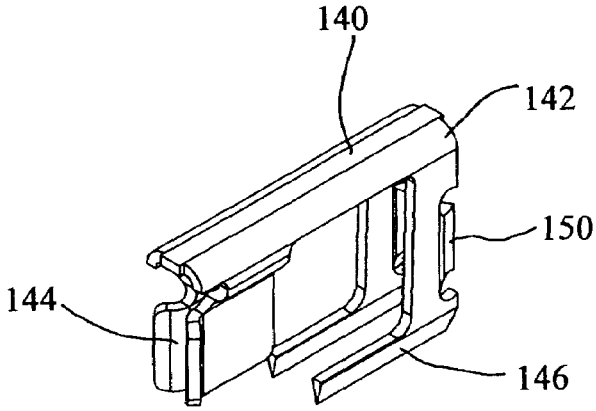
FIG. 13 is an isometric view of the ground blade conductor of the present invention.

As best shown in FIGS. 7 and 8, the neutral blade conductor 100 includes a first blade end 102 and an outlet end 104. The entire conductor 100 is formed of an electrically conducting material such as copper. The blade portion 102 has an arcuate front edge 105 and has a sharp point 101. Similarly, hot blade conductor 120 as shown in FIGS. 9, 10, 11 and 12 includes a first blade end 122 and an outlet end 124. Blade end 122 has an arcuate front surface 125 and terminates at a sharp point 121. The ground blade conductor 140 has a first blade end 142 and an outlet end 144 as is shown in FIGS. 13, 14 and 15. The blade includes a front blade edge portion 148 and a bottom edge blade portion 146. Front blade end portion 146 has a central blade segment 150 which is deformed inwardly with respect to the front edge blade portion 148 at an angle of approximately 17 degrees. In operation, as best shown in FIGS. 5 and 6, as lid 80 is closed, point 101 of blade member 100 punctures the outer sheath 14 of cable 10 at location 103. The point 121 of hot blade conductor 120 punctures the outer sheath 14 of the electrical cable at 123 and the bottom edge blade portions 146 slice through the outer sheath 14 at locations 147. As shown in FIG. 6, each of the blade portions 102, 142 and 122 make electrical contact, respectively with neutral wire N, ground wire G and hot wire H. It is to be understood that the blade 102 punctures not only the outer sheath 14, but also the insulation 18 of the neutral wire N. Similarly, blade 122 punctures not only the outer sheath 14 of the cable but also the insulation 16 provided on the hot wire H. The central blade segment 150 cuts through and displaces the paper insulation I which surrounds the ground wire G.

Figure 16:
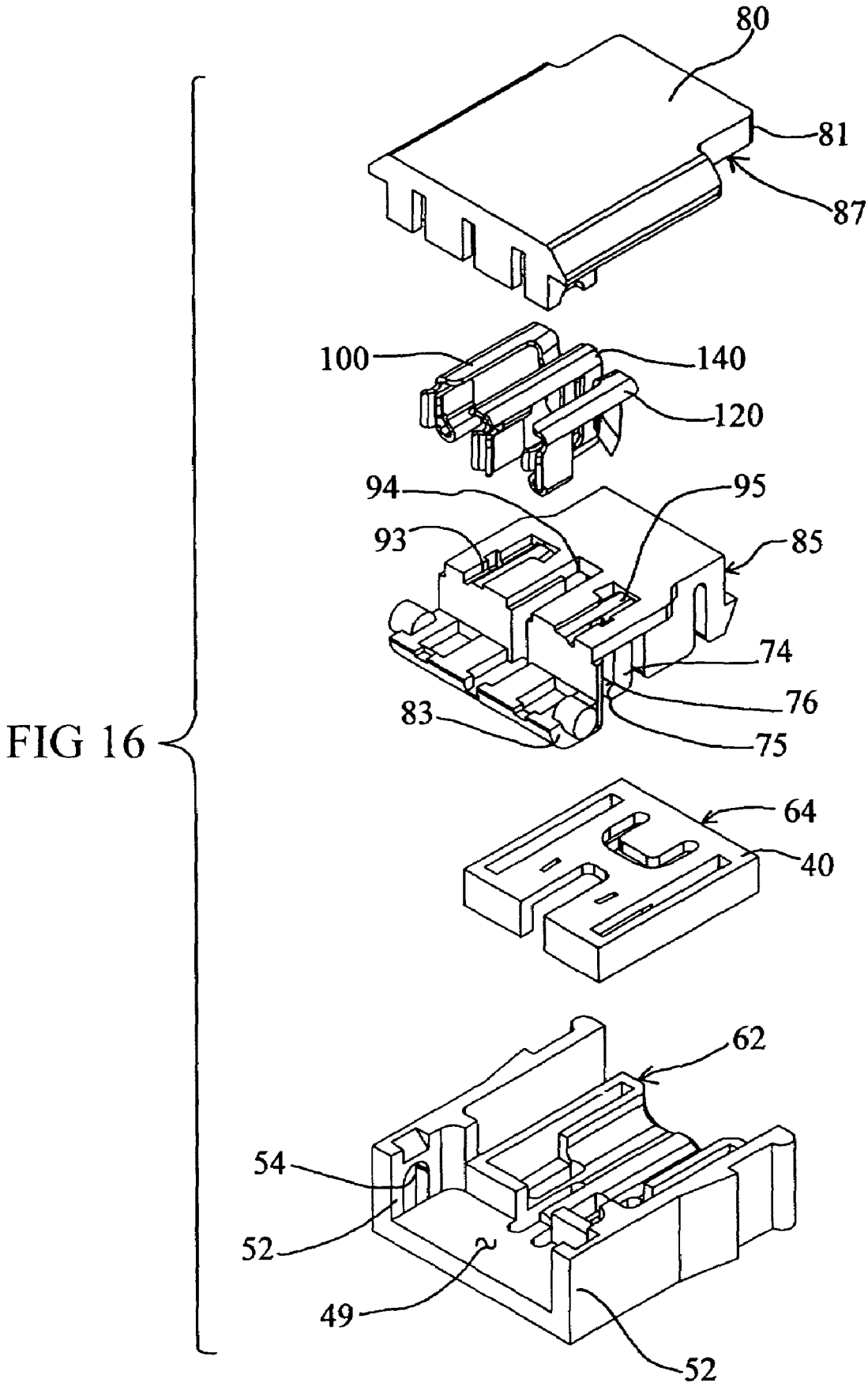
FIG. 16 is an exploded view of the lid of the present invention.
Figure 17:
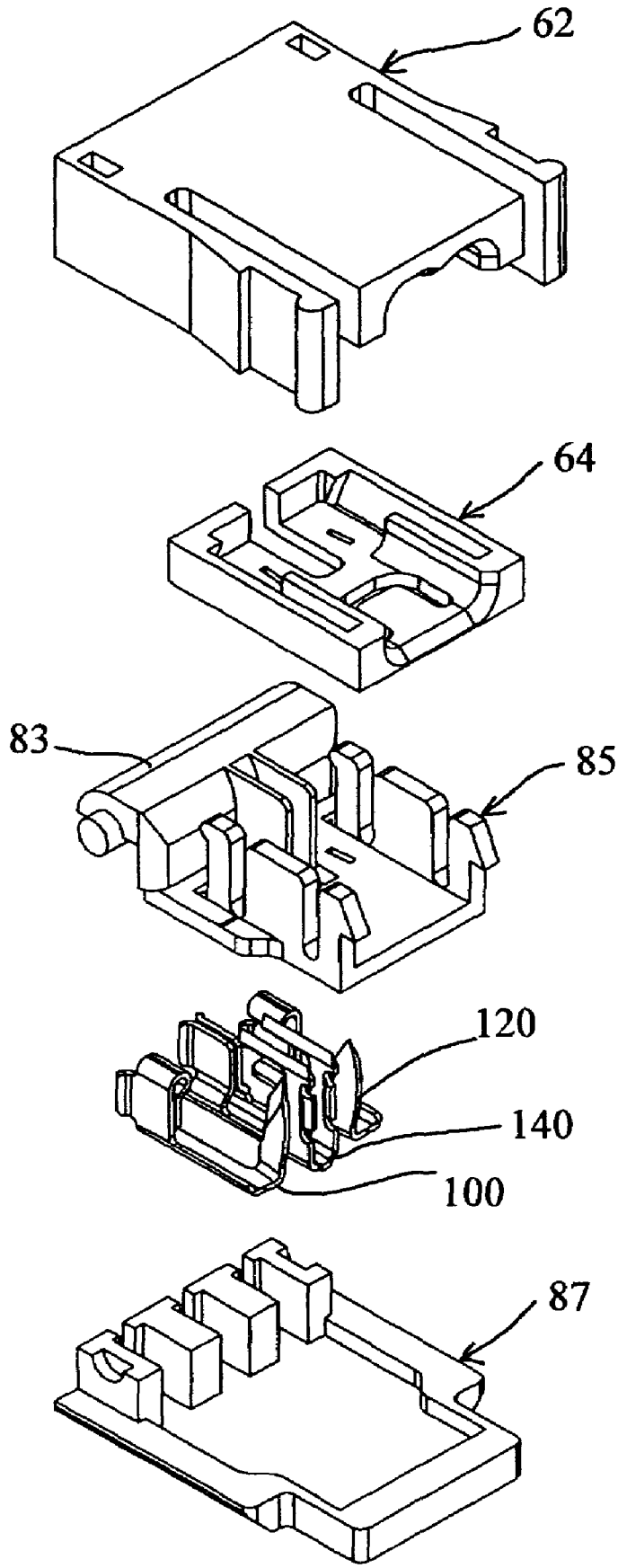
FIG. 17 is an exploded view of the body of the present invention.

As shown in FIGS. 15 and 16, the lid member 80 is preferably formed from an upper lid portion 87, a lower lid portion 85 and the blade conductors 100, 120 and 140 as shown. These components are connected together to form the lid portion of the present invention.

The body portion of the present invention is preferably formed from a top body portion 64 and a bottom body portion 62 as shown in FIGS. 15 and 16. The lid member 80 is then mounted on the body 40 for pivotal motion relative thereto.

In operation, the electrical connector 30 is received in a partially closed position held in place by the secondary latch fingers 73. Once an insulated electrical cable 10 has been transversely cut, the lid 80 is opened to a fully opened position and the cut end of the electrical cable 10 is pushed all the way in to the end of cavity 50 which, because of the shape and design of the cavity, positions the hot (H), neutral (N) and ground (G) conductors in a proper location within the cavity 50. The lid 80 is then moved from a fully opened position to a fully closed position wherein the primary latch fingers 70 secure the lid in a permanently closed position. The process is thus completed and the blades 102, 122 and 142 will have made an electrical connection respectively with the neutral, hot and ground wires of the electrical cable 10. Once the connection is made, the electrical cable with the electrical connector 30 secured to the end thereof may then be conveniently used with various compatible electrical devices. One such device, namely a coupling device, is shown in FIGS. 18, 19 and 20, although various other devices are contemplated. The present invention virtually eliminates the need to ever strip and manually wire the electrical cable to any electrical device on the job site.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. An electrical connector for providing an electrical connection to an unstripped end of an insulated electrical cable having an outer sheath within which an insulated hot wire, an insulated neutral wire, and a ground wire are enclosed comprising:

a) a body formed of an electrically insulating material, said body having a first body end and a second body end, said body having a cavity in said first body end sized to receive said unstripped end of insulated electrical cable;

b) a lid having a first lid end and a second lid end, said second lid end pivotally connected to said second body end, said lid adapted to rotate around an axis of rotation between and open position and a closed position; and c) plural blade conductors attached to said lid comprising a hot blade conductor, a neutral blade conductor, and at least one ground blade conductor, said blade conductors each having a blade end comprising at least one downwardly depending blade and an outlet portion, said blades conductors being spaced apart and attached to the lid whereby when said lid is in open position said blades do not extend within said cavity and when said lid in a closed position said blades do extend within said cavity.

2. An electrical connector according to claim 1, wherein said cavity in said body has a generally oval cross sectional configuration.

3. An electrical connector according to claim 2, wherein said cavity in said body has a central ridge provided on a bottom portion of said cavity.

4. An electrical connector according to claim 1, wherein said cavity in said body has a generally rectangular cross sectional configuration with rounded corners.

5. An electrical connector according to claim 4, wherein said cavity in said body has a central ridge provided on a bottom portion of said cavity.

6. An electrical connector according to claim 1 wherein said cavity in said body has a generally figure "8" shaped cross sectional configuration with a central ridge provided on a bottom portion of said cavity and a second central ridge on a top portion of said cavity.

7. An electrical connector according to claim 1 wherein said cavity in said body has a generally "B" shaped cross sectional configuration with rounded corners with a central ridge provided on a bottom portion of said cavity and a generally flat surface on a top portion of said cavity.

8. An electrical connector according to claim 7 wherein said cavity is adapted to receive an insulated electrical cable from one of a finite set of insulated electrical cable manufactures which each produce cables of differing widths wherein the width of said cavity is equal to the width of the most narrow cable manufactured by said finite set of manufacturers whereby sides of the cavity provide at least some frictional resistance such that the cable fits snugly within said cavity.

9. An electrical connector according to claim 8 wherein said cavity is adapted to receive an insulated electrical cable from one of a finite set of insulated electrical cable manufactures which each produce cables having a different volume of paper insulation whereby rounded portions of the cavity located on opposite side of said central ridge provide a sufficient volume of space to allow said unstripped end of insulated electrical cable from the manufacturer with the greatest volume of paper insulation to deform such that the cable fits snugly within said cavity.

10. An electrical connector according to claim 1 wherein said body has a top body surface, said top body surface having a hot blade opening, a neutral blade opening and at least one ground blade opening therein.

11. An electrical connector according to claim 10 wherein said hot blade opening, said a neutral blade opening and said at least one ground blade opening each extend from said top body surface into said cavity.

12. An electrical connector according to claim 10 wherein said hot blade opening, said neutral blade opening and said at least one ground blade opening are positioned to receive, respectively, the blade ends of said hot blade conductor, said neutral blade conductor and said at least one ground blade conductor.

13. An electrical connector according to claim 1 wherein said body has opposite side surfaces, said opposite side surfaces each having a textured gripping surface.

14. An electrical connector according to claim 13 wherein said textured gripping surfaces aid the user in gripping the connector during an insertion of an insulated electrical cable into the connector.

15. An electrical connector according to claim 13 wherein said textured gripping surfaces aid the user in gripping the connector while moving the lid from said open to said closed position.

16. An electrical connector according to claim 1 wherein said second body end has a central recess and a pair of ears on opposite sides of said central recess.

17. An electrical connector according to claim 16 wherein each of said ears has a hinge opening along said an axis of rotation.

18. An electrical connector according to claim 1 wherein said body has at least one primary latch opening.

19. An electrical connector according to claim 1 wherein said body has at least one secondary latch opening.

20. An electrical connector according to claim 1 wherein said body has a pair of lock release tabs on opposite sides of said body to allow the electrical connector to be removably secured to compatible electrical devices.

21. An electrical connector according to claim 1 wherein said body is fabricated from a lower body portion and an upper body portion which are permanently affixed together to form said body.

22. An electrical connector according to claim 1 wherein said lid is asymmetrical in cross sectional configuration.

23. An electrical connector according to claim 22 wherein said lid has a least one opposite side wall surface portion which is formed at an angle not equal to 90 degrees relative to a top surface of said lid.

24. An electrical connector according to claim 1 wherein said lid includes at least one primary latch finger.

25. An electrical connector according to claim 24 wherein said at least one primary latch finger is adapted to be received by at least one primary latch opening in said body when said lid is moved from an open to a closed position.

26. An electrical connector according to claim 25 wherein said at least one primary latch finger secures said lid in a closed position.

27. An electrical connector according to claim 26 wherein said at least one primary latch finger is adapted to enter but not exit said at least one primary latch opening whereby once said lid is closed it is permanently secured in a closed position and can not be reopened.

28. An electrical connector according to claim 26 wherein said at least one primary latch finger has a lower inclined surface thereon which, as the lid is moved from an open to a closed position, urges said at least one primary latch finger inwardly toward a centerline of said at least one primary latch opening until said lower inclined surface reaches a primary recess in said at least one primary latch opening and wherein said at least one primary latch finger has a latching ledge surface thereon, said latching ledge surface adapted to engage a locking surface within said at least one primary latch opening once said lower inclined surface reaches said primary recess.

29. An electrical connector according to claim 28 wherein said lower inclined surface and said latching ledge surface are in the form of a generally triangular tooth portion on a lower end of said at least one primary latch finger.

30. An electrical connector according to claim 1 wherein said lid includes at least one secondary latch finger.

31. An electrical connector according to claim 30 wherein said at least one secondary latch finger is adapted to be received by at least one secondary latch opening in said body when said lid is moved from an open to a partially closed position.

32. An electrical connector according to claim 31 wherein said at least one secondary latch finger secures said lid in a partially closed position.

33. An electrical connector according to claim 32 wherein said at least one secondary latch finger is adapted to enter but and exit said at least one secondary latch opening whereby once said lid is partially closed it is held in such partially closed position by friction but can be reopened to an open position by applying sufficient upward force to said lid.

34. An electrical connector according to claim 33 wherein said at least one secondary latch finger has a lower inclined surface thereon which, as the lid is moved from an open to a partially closed position, urges said at least one secondary latch finger inwardly toward a centerline of said at least one secondary latch opening until said lower inclined surface reaches a secondary recess in said at least one secondary latch opening and wherein said at least one secondary latch finger also has an upper inclined surface thereon which, as the lid is moved from an partially closed to an open position, urges said at least one secondary latch finger inwardly toward a centerline of said at least one secondary latch opening allowing the lid to be moved to an open position.

35. An electrical connector according to claim 34 wherein said lower inclined surface and said upper inclined surface are in the form of a generally semi-circular protrusion on a lower end of said at least one secondary latch finger.

36. An electrical connector for insulated cable according to claim 1 wherein said lid further comprises a pair of spaced apart insulating plates which are positioned on opposite sides of an end of said ground conductor when said lid is in a closed position.

37. An electrical connector for insulated cable according to claim 36 whereby the possibility of arcing of electrical current between an end of said ground conductor and an end of one of said insulated hot wire and said insulated neutral wire is reduced by said insulating plates.

38. An electrical connector for insulated cable according to claim 1 wherein said second lid end is provided with at least three outlet openings to provide access from outside of said connector to said hot blade conductor, said neutral blade conductor, and said at least one ground blade conductor.

39. An electrical connector for insulated cable according to claim 1 wherein said lid has a hot blade conductor channel, a neutral blade conductor channel, and said at least one ground blade conductor channel on an inner surface thereof adapted to receive and position, respectively, hot blade conductor, said neutral blade conductor, and said at least one ground blade conductor.

40. An electrical connector for insulated cable according to claim 1 wherein said first end of said lid has a downwardly extending grip strain relief member adapted to grip against and securely hold said insulated electrical cable within said electrical connector when said lid is moved to a closed position.

41. An electrical connector for insulated cable according to claim 1 wherein said lid has a generally planar configuration on said first end and has a generally cylindrical lid portion provided on said second end, said cylindrical lid portion adapted to be attached for pivotal movement within a central recess in said body portion between a pair of ears provided on opposite sides of said central recess on said body.

42. An electrical connector for insulated cable according to claim 1 wherein said lid is formed from an upper lid member and a lower lid member between which said plural blade conductors are positioned and attached.

43. An electrical connector for insulated cable according to claim 1 wherein said blade portions of said hot blade conductor, said neutral blade conductor, and said at least one ground blade conductor make electrical contact, respectively, with a hot conductor wire, a neutral conductor wire, and a ground conductor wire when said lid is moved from an open to a closed position with an unstripped end of an insulated electrical cable present in said cavity.

44. An electrical connector for insulated cable according to claim 43 wherein said at least one ground blade conductor includes a pair of spaced apart blade members wherein in a closed position a ground blade member is in electrical contact on opposite sides of a single ground conductor wire.

45. An electrical connector for insulated cable according to claim 44 wherein said pair of said ground blade members aid in securing and holding said ground conductor wire in a desired position within the electrical connector when said lid is in a closed position.

46. An electrical connector for insulated cable according to claim 44 wherein said pair of ground blade members are spaced apart a distance no greater than the diameter of said ground conductor wire.

47. An electrical connector for insulated cable according to claim 44 wherein said pair of ground blade members are spaced apart a distance slightly less than the diameter of said conductors and wherein said spaced apart blades exert inward force on opposite sides of said conductors.

48. An electrical connector for insulated cable according to claim 44 wherein when said lid is moved from an open position to a closed position, with an unstripped end of insulated electrical cable present in the cavity, said ground blade members slice through the outer sheath of said electrical cable and move to a location where said ground blade members are in electrically contact with said ground conductor wire.

49. An electrical connector for insulated cable according to claim 1 wherein when said lid is moved from an open position to a closed position, with an unstripped end of insulated electrical cable present in the cavity, said blade portions of said hot blade conductor and said neutral blade conductor, respectively, puncture through said outer sheath and puncture through the insulation of said hot conductor wire and said neutral conductor wire.

50. An electrical connector for insulated cable according to claim 49 wherein said hot wire conductor blade makes electrical contact with said hot conductor wire on a side of said hot wire most distant from said ground wire and said neutral wire conductor blade makes electrical contact with said neutral conductor wire on a side of said neutral wire most distant from said ground wire.

51. An electrical connector for insulated cable according to claim 1 wherein said at least one ground wire conductor blade is generally "L" shaped.

52. An electrical connector for insulated cable according to claim 51 wherein said at least one ground wire conductor blade is provided along a front edge and along a bottom edge of a generally rectangular insulating plate member.

53. An electrical connector for insulated cable according claim 1 wherein said at least one ground wire conductor blade has a bottom edge blade portion.

54. An electrical connector for insulated cable according to claim 53 wherein said bottom edge blade portion slices the outer sheathing as the lid is moved from an open position to a closed position when an insulated cable is present in the cavity.

55. An electrical connector for insulated cable according to claim 1 wherein said at least one ground wire conductor blade has a front edge blade portion.

56. An electrical connector for insulated cable according to claim 55 wherein said front edge blade portion has a central blade segment, said central blade segment deformed inwardly with respect to said front edge blade portion, said central blade segment has a leading edge, whereby when the lid is moved from an open position to a closed position with an insulated cable present in the cavity, said leading edge of said central blade segment cuts into a side portion of the ground conductor wire.

57. An electrical connector for insulated cable according 56 wherein said central blade segment is deformed inwardly with respect to said front edge blade portion at an angle of approximately 17 degrees.

58. An electrical connector according to claim 1 wherein said a hot blade conductor and said a neutral blade conductor have blades having a forward edge which is curved along arc having a radius point located at an axis of rotation of said lid.

59. An electrical connector according to claim 1 wherein said a hot blade conductor and said a neutral blade conductor have blades having a sharp point on a lowermost end thereof.

60. An electrical connector for insulated cable according to claim 59 wherein each of said outlet portion of said conductor blade members is in the form of one of a male plug member and a female receptacle member.

61. An electrical connector for insulated cable according to claim 1 further comprising a coupling device adapted to receive the second end of a pair of electrical connectors whereby a splice connecting two unstripped ends of insulated electrical cable having an outer sheath within which an insulated hot wire, an insulated neutral wire, and a ground wire are enclosed can be efficiently provided.

62. An electrical connector according to claim 61 wherein said coupling device includes two open ends to receive an outlet portion of said electrical connectors and wherein said coupling device has three conducting blades to provide an electrical connection for one open end to an opposite open end thereof.

* * * * *